US009132673B2

(12) United States Patent
Fletcher et al.

(10) Patent No.: US 9,132,673 B2
(45) Date of Patent: Sep. 15, 2015

(54) SEMI-CONDUCTIVE MEDIA TRANSPORT FOR ELECTROSTATIC TACKING OF MEDIA

(71) Applicant: Xerox Corporation, Norwalk, CT (US)

(72) Inventors: Gerald M. Fletcher, Pittsford, NY (US); Palghat S. Ramesh, Pittsford, NY (US); Peter J. Knausdorf, Henrietta, NY (US); Joannes N.M. de Jong, Hopewell Junction, NY (US)

(73) Assignee: Xerox Corporation, Norwalk, CT (US)

( * ) Notice: Subject to any disclaimer, the term of this patent is extended or adjusted under 35 U.S.C. 154(b) by 35 days.

(21) Appl. No.: 13/727,841

(22) Filed: Dec. 27, 2012

(65) Prior Publication Data

US 2014/0184712 A1 Jul. 3, 2014

(51) Int. Cl.

| | |
|---|---|
| ***B41J 13/08*** | (2006.01) |
| ***B41J 11/00*** | (2006.01) |
| ***B65H 5/00*** | (2006.01) |
| ***B65H 5/02*** | (2006.01) |

(52) U.S. Cl.

CPC ..... *B41J 13/08* (2013.01); *B41J 11/007* (2013.01); *B65H 5/004* (2013.01); *B65H 5/021* (2013.01); *B65H 2404/2221* (2013.01); *B65H 2404/533* (2013.01)

(58) Field of Classification Search

None

See application file for complete search history.

(56) References Cited

U.S. PATENT DOCUMENTS

| | | | | |
|---|---|---|---|---|
| 2001/0028380 | A1* | 10/2001 | Wotton et al. | 347/102 |
| 2006/0109325 | A1* | 5/2006 | Araya et al. | 347/101 |
| 2009/0255460 | A1* | 10/2009 | Castelli et al. | 118/46 |

OTHER PUBLICATIONS

U.S. Appl. No. 13/669,578, titled "Improved Media Tacking to Media Transport Using a Media Tacking Belt", filed Nov. 16, 2012.

U.S. Appl. No. 13/557,784, titled "A System and Method for Reducing Electrostatic Fields Underneath Print Heads in an Electrostatic Media Transport", filed Jul. 25, 2012.

U.S. Appl. No. 13/589,356, titled "System and Method for Adjusting an Electrostatic Field in an Inkjet Printer", filed on Aug. 20, 2012.

* cited by examiner

*Primary Examiner* — Justin Seo

(74) *Attorney, Agent, or Firm* — Hoffmann & Baron, LLP.

(57) ABSTRACT

A semi-conductive media transport is used with an ink jet printing system. A belt is held flat and slides across a conductive platen, causing electrostatic charges on the belt. The belt is made semi-conductive to prevent charge buildup. The belt has an effective surface resistivity between a lower limit to preclude a buildup of electrostatic charges, and an upper limit to enable electrostatic tacking of the media to the belt. The resistivity limits vary depending upon belt velocity, thickness, material, belt and media dielectric constant, and slot width. A pair of charged nip rollers tacks the media substrate to the belt. An AC corotron is disposed above the belt to establish a net neutral charge state on the media substrate and the belt. Platen slots directly below the ink jet print heads will maintain the net neutral charge state on the media substrate and the belt.

9 Claims, 5 Drawing Sheets

SEMI-CONDUCTIVE MEDIA TRANSPORT FOR ELECTROSTATIC TACKING OF MEDIA

INCORPORATION BY REFERENCE

U.S. patent application Ser. No. 13/669,578, filed on Nov. 16, 2012, entitled "Improved media tacking to media transport using a media tacking belt," and assigned to the assignee hereof is incorporated in its entirety for the teachings therein. U.S. patent application Ser. No. 13/557,784, filed on Jul. 25, 2012, entitled "A system and method for reducing electrostatic fields underneath print heads in an electrostatic media transport," and assigned to the assignee hereof is incorporated in its entirety for the teachings therein. U.S. patent application Ser. No. 13/589,356, filed on Aug. 17, 2012, entitled "A system and method for adjusting electrostatic fields underneath print heads in an electrostatic media transport," and assigned to the assignee hereof is incorporated in its entirety for the teachings therein.

TECHNICAL FIELD

The presently disclosed technologies are directed to an apparatus and method that uses a semi-conductive media transport, or belt, to maintain tacking performance of a wide range of media while avoiding build-up of friction induced electric field, in a media handling assembly such as a printing system.

BACKGROUND

In media handling assemblies, particularly in printing systems, strong, consistent, and reliable tacking of the substrate media, such as a sheet of paper, to the media transport (hold-down transport in the print zone or image transfer zone, in this case a belt) is necessary. FIG. 1 depicts an exemplary production printing system that could make use of the semi-conductive media transport. Media is transported from a storage tray onto the belt using a traditional nip based registration transport with nip releases. As soon as the leading edge of the media is acquired by the belt, the registration nips are released. The substrate media is generally conveyed within the system in a process direction.

In order to ensure good print quality in direct to paper (DTP) ink jet printing systems, the media must be held extremely flat in the print zone. The belt itself is held flat against a platen. Further, once accurate registration of the substrate media is achieved, the media cannot be allowed to move out of registration as it is delivered to the print zone. Contemporary systems transfer media by means of laterally spaced apart drive rollers in registration nip assemblies. The rollers do not hold the media flat, and can subject the media to misalignment. Media acquisition by the belt can be by electrostatic tacking. The electrostatic tacking has the advantages of holding the media flat, and eliminating registration shift. In addition, a vacuum on the platen may be used to ensure flatness. A problem arises in that friction induced tribo-electric charges between the belt and the platen (and elsewhere) generate undesirable electrostatic fields in the ink ejection area which may adversely affect print quality. The use of a conductive belt will circumvent this but this can make it difficult to achieve desirable low, controlled fields between the media and a print head over a wide range of media properties.

One problem sometimes encountered in electrostatic tacking is charge migration and subsequent loss of tacking force between the media and the belt. This problem can be minimized by utilizing an insulating belt as a media transport. To avoid tribo-induced electric fields, a belt with sufficient conductivity, that is, a semi-conductive belt is desirable.

Accordingly, it would be desirable to provide an apparatus capable of holding the media flat by electrostatic tacking, and of ensuring tacking performance, while reducing tribo-induced electric fields, thereby avoiding the problems associated with the prior art.

SUMMARY

In one aspect, a semi-conductive media transport is used in connection with a printing system and a media substrate having opposite top and bottom surfaces. The printing system has at least one ink jet print head, or imaging print head, for ejecting ink onto the media substrate. The semi-conductive media transport comprises a conductive platen and a belt having opposite top and bottom surfaces. The belt is held flat against the platen, the belt being able to slidingly move across the platen. The belt has a resistivity between a predetermined resistivity lower limit and a predetermined resistivity upper limit. The resistivity lower limit is low enough to preclude a buildup of friction induced electrostatic charges as the belt moves across the platen. The resistivity upper limit is high enough to enable electrostatic tacking of the media substrate to the belt. A primary charging device is provided for generating an electrostatic charge on the media substrate and on the belt, so as to enable electrostatic tacking of the media substrate to the belt.

In another aspect, a semi-conductive media transport is used in connection with a printing system and a media substrate having opposite top and bottom surfaces. The printing system has at least one ink jet print head for ejecting ink onto the media substrate. The semi-conductive media transport comprises a conductive platen having at least one platen slot through the platen, the platen slot being opposite the ink jet print head. The platen slot is adapted to maintain a very low electrostatic field between the media substrate and the ink jet print head. A belt is provided having opposite top and bottom surfaces. The belt is held flat against the platen, and is able to slidingly move across the platen. The belt has a resistivity between a predetermined resistivity lower limit and a predetermined resistivity upper limit. The resistivity lower limit is low enough to preclude a buildup of friction induced electrostatic charges as the belt moves across the platen. The resistivity upper limit is high enough to enable electrostatic tacking of the media substrate to the belt. A conductive upper nip roller is disposed above the belt upstream of the platen. The upper nip roller is adapted to carry a first electrical charge and to pass the first charge to the media substrate. A conductive lower nip roller is disposed opposite the upper nip roller and below the belt upstream of the platen. The lower nip roller is adapted to carry a second electrical charge opposite in polarity to the first charge on the upper nip roller and to pass the second charge to the belt for generating an electrostatic charge on the media substrate and on the belt. This enables electrostatic tacking of the media substrate to the belt.

In yet another aspect, a semi-conductive media transport is used in connection with a printing system and a media substrate having opposite top and bottom surfaces. The printing system has a plurality of ink jet print heads for ejecting ink onto the media substrate. The semi-conductive media transport comprises a conductive platen having a plurality of platen slots through the platen. The platen slots are each disposed opposite a respective one of the ink jet print heads. The platen slots are adapted to maintain a very low electrostatic field between the media substrate and the ink jet print heads. A belt is provided having opposite top and bottom surfaces. The belt is held flat against the platen, and is able to slidingly move across the platen. The belt has a resistivity between a predetermined resistivity lower limit and a predetermined resistivity upper limit. The resistivity lower limit is low enough to preclude a buildup of friction induced electrostatic charges as the belt moves across the platen. The resistivity upper limit is high enough to enable electrostatic tacking of the media substrate to the belt. A conductive upper nip roller is disposed above the belt upstream of the platen. The upper nip roller is adapted to carry a first electrical charge and to pass the first charge to the media substrate. A conductive lower nip roller is disposed opposite the upper nip roller and below the belt upstream of the platen. The lower nip roller is adapted to carry a second electrical charge opposite in polarity to the first charge on the upper nip roller and to pass the second charge to the belt for generating an electrostatic charge on the media substrate and on the belt. This enables electrostatic tacking of the media substrate to the belt.

A secondary charging device, typically an electrostatic field reducer system using a corona discharge device, is disposed above the belt and downstream of the upper nip roller. An example of such a device is an AC corotron, or equivalent charging device such as is known in xerography. The corotron is adapted to establish a charge on the media substrate that is equal in magnitude and opposite in polarity to the charge on the belt. The effect is to create a net neutral charge state for the media and the belt. The platen slots below the imaging print heads, in combination with the net neutral charge state, serve to maintain a very low electrostatic field between the media and the imaging print heads.

In still another aspect, a method is disclosed for tacking a media substrate to a media transport belt, while reducing friction induced electrostatic charges, for use in connection with a printing system. A media substrate has opposite top and bottom surfaces. The printing system has a plurality of ink jet print heads for ejecting ink onto the media substrate. The method comprises generating an electrostatic charge on the media substrate and on the belt, tacking the media substrate to the belt with the electrostatic charge, and providing a belt resistivity between a lower limit and an upper limit, wherein the resistivity lower limit is low enough to preclude a buildup of friction induced electrostatic charges as the belt moves across the platen, and the resistivity upper limit is high enough to enable electrostatic tacking of the media substrate to the belt.

These and other aspects, objectives, features, and advantages of the disclosed technologies will become apparent from the following detailed description of illustrative embodiments thereof, which is to be read in connection with the accompanying drawings.

DETAILED DESCRIPTION

Describing now in further detail these exemplary embodiments with reference to the Figures as described above, the Semi-Conductive Media Transport For Electrostatic Tacking Of Media system is typically used in a select location or locations of the paper path or paths of various conventional media handling assemblies. Thus, only a portion of an exemplary media handling assembly path is illustrated herein. It should be noted that the drawings herein are not to scale.

As used herein, a "printer," "printing assembly" or "printing system" refers to one or more devices used to generate "printouts" or a print outputting function, which refers to the reproduction of information on "substrate media" or "media substrate" for any purpose. A "printer," "printing assembly" or "printing system" as used herein encompasses any apparatus, such as a digital copier, bookmaking machine, facsimile machine, multi-function machine, etc. which performs a print outputting function.

A printer, printing assembly or printing system can use an "electrostatographic process" to generate printouts, which refers to forming and using electrostatic charged patterns to record and reproduce information, a "xerographic process", which refers to the use of a resinous powder on an electrically charged plate to record and reproduce information, or other suitable processes for generating printouts, such as an ink jet process, a liquid ink process, a solid ink process, and the like. Also, such a printing system can print and/or handle either monochrome or color image data.

As used herein, "media substrate" refers to, for example, paper, transparencies, parchment, film, fabric, plastic, photo-finishing papers or other coated or non-coated substrates on which information can be reproduced, preferably in the form of a sheet or web. While specific reference herein is made to a sheet or paper, it should be understood that any media substrate in the form of a sheet amounts to a reasonable equivalent thereto. Also, the "leading edge" of a media substrate refers to an edge of the sheet that is furthest downstream in the process direction.

As used herein, a "media handling assembly" refers to one or more devices used for handling and/or transporting media substrate, including feeding, printing, finishing, registration and transport systems.

As used herein, the terms "process" and "process direction" refer to a process of moving, transporting and/or handling a substrate media. The process direction is a flow path the media substrate moves in during the process.

Scientific notation will be used herein, for example, 1.E12 means 1×10 to the power of 12.

Figure 1:
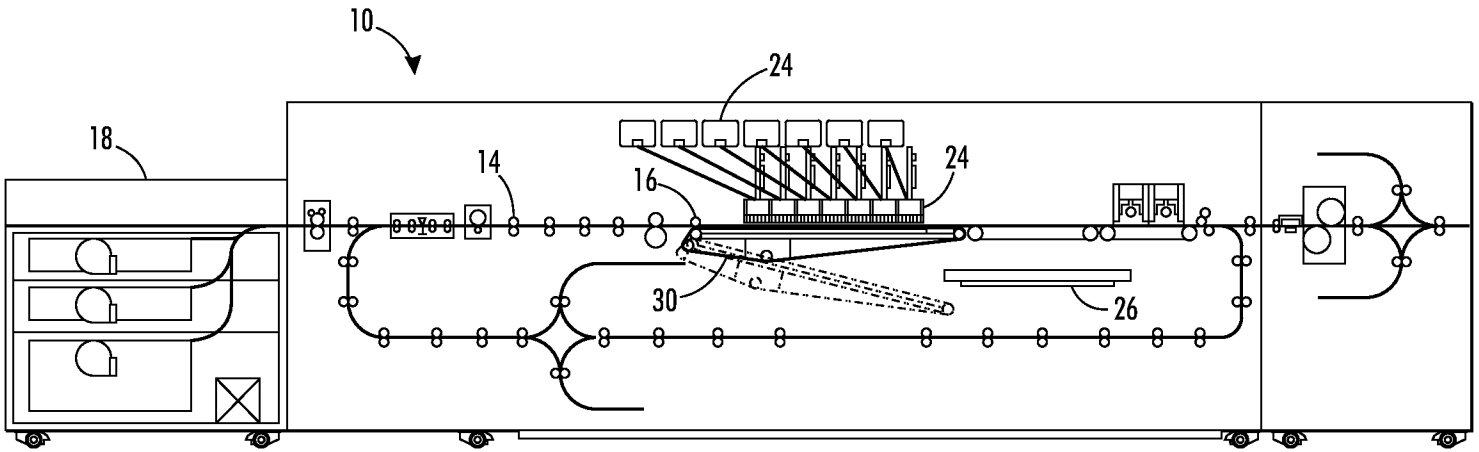
FIG. 1 is a side elevational, sectional view of an exemplary production printing system that could make use of the disclosed technologies.

FIG. 1 depicts an exemplary production printing system 10 having nip rollers 14, a media transport belt 30 and a media acquisition area 16, where the media substrate 18 is tacked onto the media transport belt 30. The printing system 10 has a plurality of ink jet print heads 24 for ejecting ink onto the media substrate 18.

Figure 2:
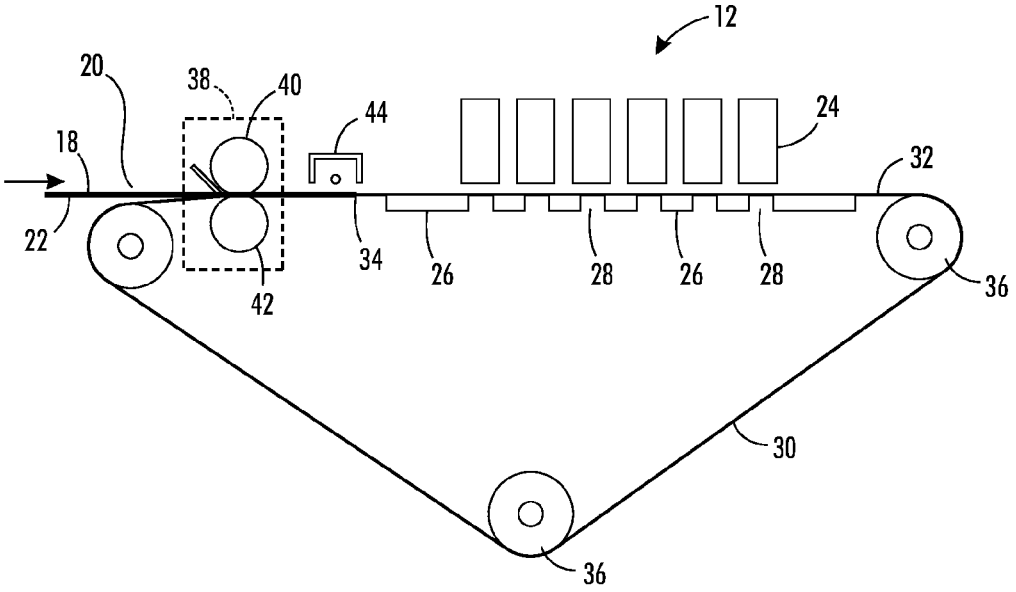
FIG. 2 is a schematic side elevational, sectional view of an exemplary print zone transport system for use with the disclosed technologies.

FIG. 2 shows a semi-conductive media transport 12, for use in connection with a printing system such as the example in FIG. 1. A media substrate 18 has opposite top 20 and bottom 22 surfaces. The printing system has a plurality of ink jet print heads 24 for ejecting ink onto the media substrate 18. The semi-conductive media transport includes a conductive platen 26 having a plurality of platen slots 28 through the platen 26. The platen slots 28 are each disposed opposite a respective one of the ink jet print heads 24. The platen slots 28 maintain a very low electrostatic field between the media substrate 18 and the ink jet print heads 24.

A belt 30 has opposite top 32 and bottom 34 surfaces. The belt 30 is held flat against the platen 26. The belt 30 is able to slidingly move across the platen 26. The movement of the belt 30 across the platen 26 manifests friction, which generates tribo-electric charges on the belt 30. These charges tend to degrade the ink jet pattern being ejected from the print heads 24 onto the media substrate 18, resulting in a poor quality print. In order to mitigate the problem, the belt 30 is made semi-conductive to prevent charge buildup. One or more of the metal belt rollers 36 may be grounded. The belt 30 has an effective surface resistivity between a predetermined resistivity lower limit and a predetermined resistivity upper limit. The resistivity lower limit is low enough to preclude a buildup of friction induced electrostatic charges as the belt 30 moves across the platen 26. The resistivity upper limit is high enough to enable electrostatic tacking of the media substrate 18 to the belt 30. The resistivity used here will be surface resistivity, which is bulk or volume resistivity in ohm-cm divided by thickness in cm. The units here are ohms, unless otherwise noted. The belt resistivity limits can range, preferably, from a lower limit of approximately 1.E11 ohms to an upper limit of approximately 1.E12 ohms. However, the limits can also range from a lower limit of approximately 1.E10 ohms to an upper limit of approximately 1.E13 ohms. Further, the limits can also range from a lower limit of approximately 1.E9 ohms to an upper limit of approximately 1.E14 ohms. The resistivity limits vary depending upon specific parameters of belt velocity, belt thickness, belt material, belt and media dielectric constant, and slot width or gap.

The belt 30 can have multiple layers. If multiple layers are used, the bottom most layer should have the surface resistivity ranges discussed in the above paragraph. However, the layers above the bottom layer can have a higher volume resistivity range than the bottom layer. The lower limit for the volume resistivity of these layers is the same as the lower limit determined for the surface resistivity discussed above. That is, the quantity "volume resistivity divided by the layer thickness" (referred to as surface resistivity in above discussions) must still meet the lower limit of the levels discussed above. However, the upper limit for the volume resistivity is unrestricted and can be any value greater than the value of volume resistivity determined by the lower limit restrictions. That is, the upper limit restrictions can be removed for the layers above the bottom layer.

A primary charging device is provided for generating an electrostatic charge on the media substrate and on the belt. A media acquisition area 38 includes a pair of nip rollers carrying electrical charges to tack the media substrate 18 to the belt 30. A conductive upper nip roller 40 is disposed above the belt 30 upstream of the platen 26. The upper nip roller 40 will carry a first electrical charge and pass the first charge to the media substrate 18. A conductive lower nip roller 42 is disposed opposite the upper nip roller 40 and below the belt 30 upstream of the platen 26. The lower nip roller 42 will carry a second electrical charge opposite in polarity to the first charge on the upper nip roller 40. The nip rollers 40 and 42 will pass these charges to the media substrate 18 and the belt 30 respectively, for generating an electrostatic charge on the media substrate and on the belt. This will enable electrostatic tacking of the media substrate 18 to the belt 30. Although roller charging will be described here as one example, many alternative media charging systems that are well known in the art of charging systems can be used to charge the media and belt. For further example, various types of charging systems can replace the biased roller 40 in FIG. 2 such a biased blade or various types of non-contact corona charging systems that are well known in the art.

A secondary charging device, an AC corotron 44 or equivalent charging device such as is known in xerography, is disposed above the belt 30 and downstream of the upper nip roller 40. As indicated, the secondary charging device is placed in a region where conductive members below the belt, such as the conductive platen 26, are very far from the active region of the charging device 44. Very far generally means greater than around 10 mm from the charging device. After tacking of the media substrate 18 by the nip rollers 40 and 42, the field above the media top surface 20 will be neutralized by the corotron 44. The corotron 44 will establish a charge on the top surface 20 of the media substrate 18 that is equal and opposite in polarity to the charge on the belt. According to Gauss's law, this will create a substantially zero field above the media. The platen slots 28 opposite the ink ejection area directly below the ink jet print heads 24, and the net neutral media plus belt charge, will maintain the substantially zero field between the top surface 20 of the media substrate 18 and the active regions of the print heads.

Figure 3:
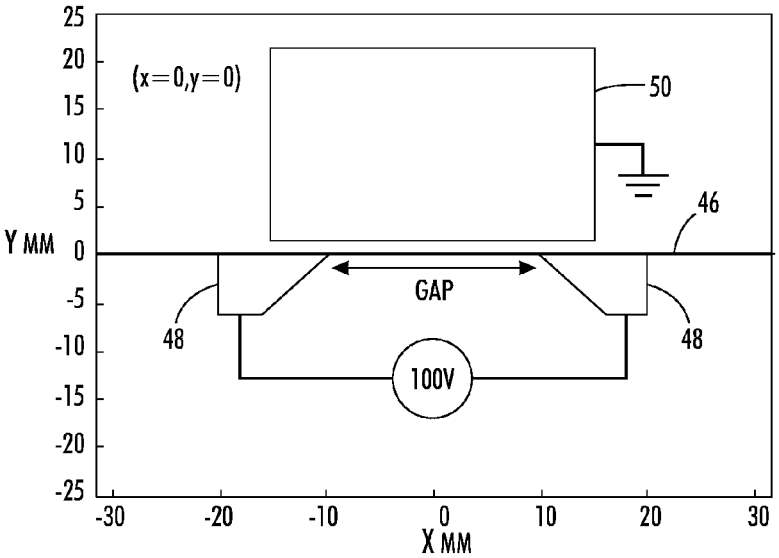
FIG. 3 is a schematic of a model used to determine the range of resistivity of the media transport of FIG. 2.

The range of resistivity of material used in the media transport belt 30 has been determined from a model shown schematically in FIG. 3, which is based upon the configuration in FIG. 2. The model solves for electric fields in the print zone as a function of geometry, including slot gap width and belt thickness, and material properties such as belt resistivity, belt dielectric, and media dielectric. The initial charge distribution of the belt and paper coming into the print zone is also modeled by simulating air breakdown in the upstream electrostatic tacking nip and AC corotron. The model depicts a semi-conductive belt 46 stretched across two electrodes 48 biased at 100v. A ground plane 50 is 1.5 mm above the belt surface. The voltage field at the belt surface between the two electrodes is determined as a function of belt resistivity at X=0, Y=0.

Figure 4:
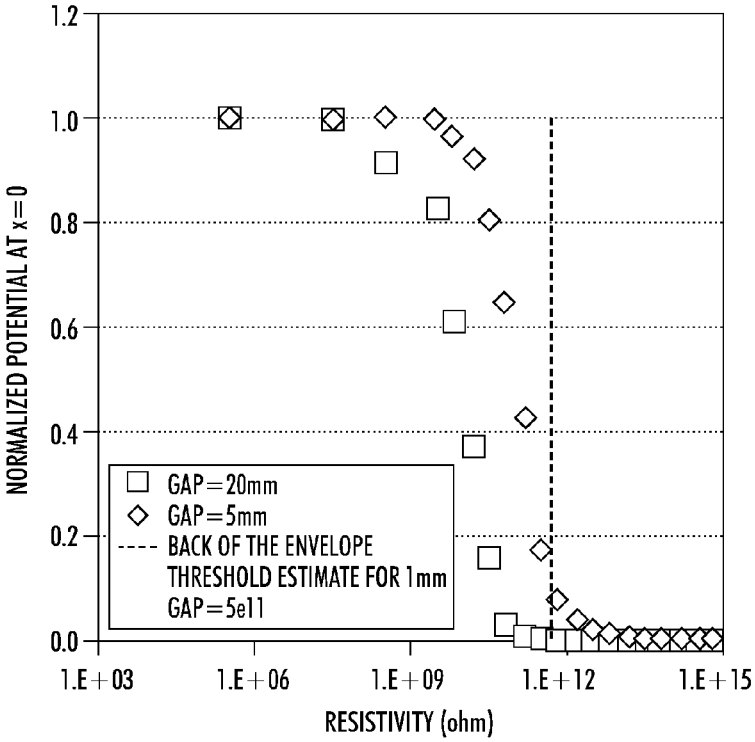
FIG. 4 shows the output of the model of FIG. 3.

The output of the model is depicted in FIG. 4, where normalized potential is plotted as a function of belt resistivity for gaps of 5 mm and 20 mm at a speed of 1. m/s. The dashed line is an estimate for a gap of 1 mm. For the purpose of electrostatic field magnitude, the behavior of the belt changes from conductive to non-conductive at approximately 1.E11. As shown in FIG. 4, belts with a resistivity from about 1.E11 to 1.E12 will act as an insulator for electrostatic tacking purposes while being sufficiently conductive to bleed off tribo-induced charges. As recited above, actual values will depend upon parameters of speed, material, gap, etc.

Figure 5:
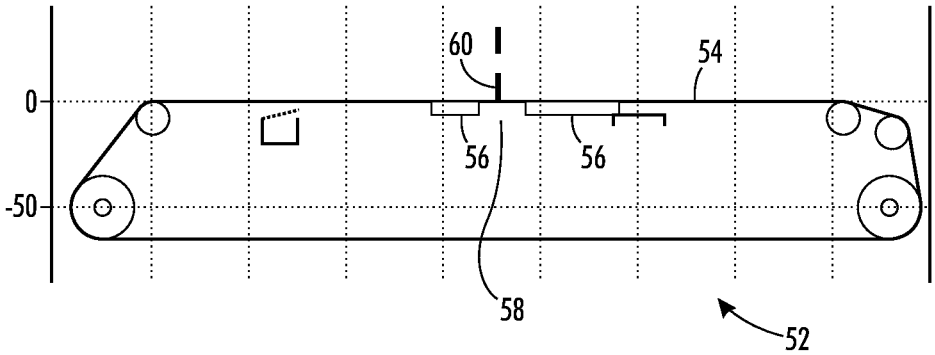
FIG. 5 is a schematic side elevational view of a test fixture used to verify aspects of the model of FIG. 3.
Figure 6:
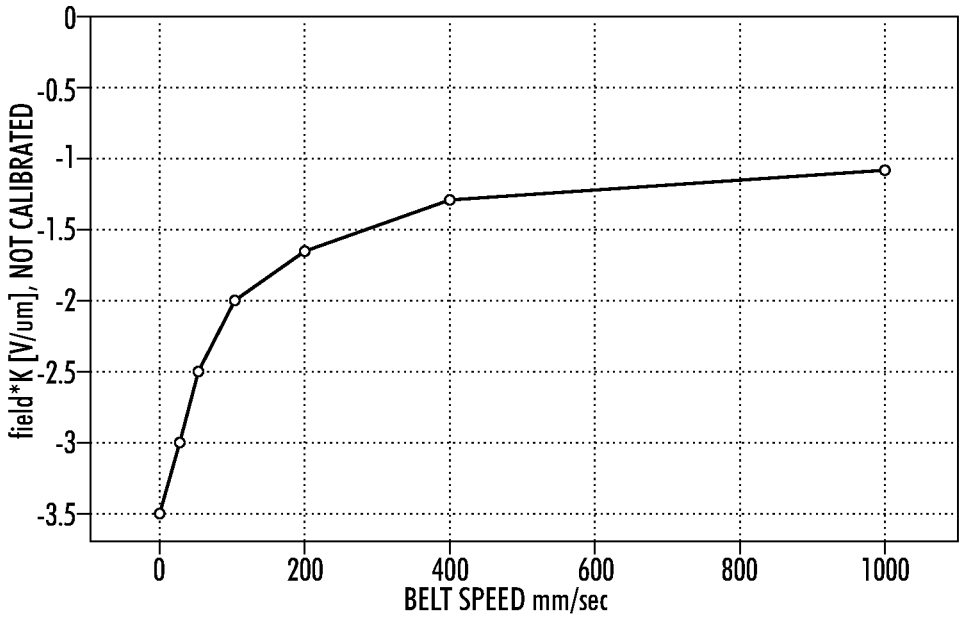
FIG. 6 is a graphical representation of data empirically derived from the test fixture of FIG. 5.
Figure 7:
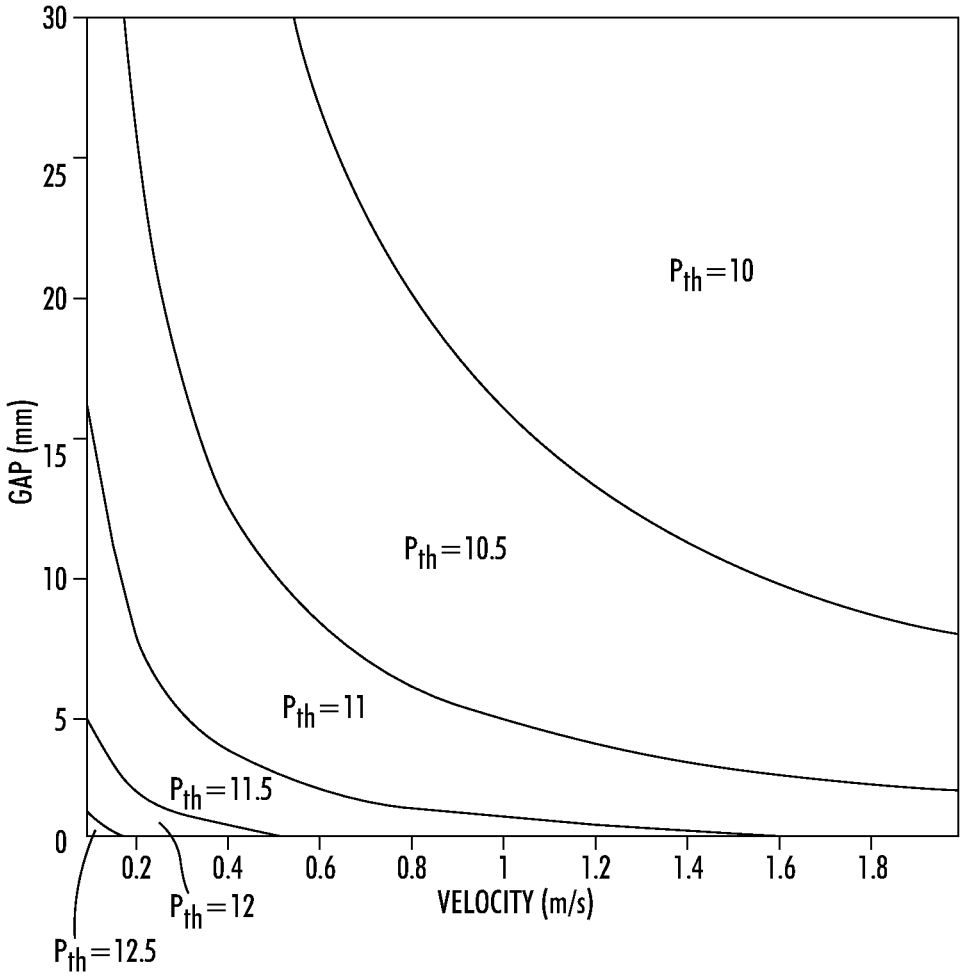
FIG. 7 is a graphical representation of threshold resistivity as a function of gap and belt speed.

A fixture 52 shown in FIG. 5 was fabricated to verify aspects of the model. The belt used was a semi-conductive belt 54 with a measured resistivity of 4.E11 ohms. A potential of 2000 volts was applied to plates 56 separated by a gap 58 of 25 mm. The measurement of the field probe 60 (Y axis) spaced 1.5-2 mm above the belt 54 was recorded as a function of belt speed (X axis). The derived data in FIG. 6 shows an increase in apparent resistivity as the belt speed increases. This agrees with the model, which indicates that the threshold resistivity should decrease as speed increases, which equates to the belt behaving more resistive as speed is increased. FIG. 7 illustrates the threshold resistivity as a function of gap and speed.

As an alternative for use with high moisture content papers, the belt 30 can include a coating (not shown) on the top surface 32. The purpose of this coating is to prevent significant conductive charge exchange between a relatively conductive high moisture content paper and the top surface of the belt during dwell time T, for transport of the paper from the initial media charging zone 38 in FIG. 2 to the position of the roller 36. The desired condition for the coating is that the time for conductive migration or "relaxation" of charge through the thickness of the coating should be greater than the dwell time T. For special cases of simply behaved conduction in materials, the relaxation time can generally be given by the product of the material's dielectric constant K, the volume resistivity ρ, and the constant referred to as the permittivity of air $\epsilon_0$ (8.85.E-14 farads/cm). Typically the preferred coating resistivity will be above around 1.E12 ohm-cm. For example, for a dwell time T of around 0.5 second and a typical material with a dielectric constant of around 3, the coating should have a volume resistivity of above approximately 2.E12 ohm-cm. The coating will have a thickness in the range of approximately 10 to 200 microns.

While six ink jet print heads 24 and six platen slots 28 are shown, it should be understood that fewer or greater numbers of print heads and platen slots could be used, depending on the type of printing system.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A semi-conductive media transport, for use in connection with a printing system and a media substrate having opposite top and bottom surfaces, the printing system having at least one ink jet print head for ejecting ink onto the media substrate, the semi-conductive media transport comprising:

a conductive platen;

a belt having opposite top and bottom surfaces, the belt being held flat against the platen, the belt being able to slidingly move across the platen, the belt having an effective surface resistivity between a predetermined resistivity lower limit and a predetermined resistivity upper limit, wherein the resistivity lower limit is low enough to preclude a buildup of friction induced electrostatic charges as the belt moves across the platen, and the resistivity upper limit is high enough to enable electrostatic tacking of the media substrate to the belt; and a primary charging device for generating an electrostatic charge on the media substrate and on the belt, so as to enable electrostatic tacking of the media substrate to the belt.

2. The semi-conductive media transport of claim 1, wherein the primary charging device further comprises:

a conductive upper nip roller disposed above the belt upstream of the platen, the upper nip roller being adapted to carry a first electrical charge and to pass the first charge to the media substrate; and a conductive lower nip roller disposed opposite the upper nip roller and below the belt upstream of the platen, the lower nip roller being adapted to carry a second electrical charge opposite in polarity to the first charge on the upper nip roller and to pass the second charge to the belt.

3. The semi-conductive media transport of claim 2, further comprising a secondary charging device disposed above the belt and downstream of the upper nip roller, the secondary charging device being adapted to establish a net neutral charge state on the media substrate and the belt.

4. The semi-conductive media transport of claim 3, wherein the platen further comprises at least one slot through the platen, the slot being opposite the at least one ink jet print head, the slot being adapted to maintain the net neutral charge state on the media substrate and the belt.

5. The semi-conductive media transport of claim 1, further comprising:

the resistivity lower limit being approximately 1.E11 ohms; and the resistivity upper limit being approximately 1.E12 ohms.

6. The semi-conductive media transport of claim 1, further comprising:

the resistivity lower limit being approximately 1.E10 ohms; and the resistivity upper limit being approximately 1.E13 ohms.

7. The semi-conductive media transport of claim 1, further comprising:

the resistivity lower limit being approximately 1.E9 ohms; and the resistivity upper limit being approximately 1.E14 ohms.

8. The semi-conductive media transport of claim 1, for use with high moisture content papers, wherein the belt further comprises a coating on the top surface, the coating having a volume resistivity of above approximately 1.E12 ohm-cm, the coating having a thickness in the range of approximately 10 to 200 microns.

9. A method for tacking a media substrate to a media transport belt, while reducing friction induced electrostatic charges, for use in connection with a printing system and a media substrate having opposite top and bottom surfaces, the printing system having a plurality of ink jet print heads for ejecting ink onto the media substrate, the method comprising:

generating an electrostatic charge on the media substrate and on the belt;

tacking the media substrate to the belt with the electrostatic charge; and providing a belt effective surface resistivity between a lower limit and an upper limit, wherein the resistivity lower limit is low enough to preclude a buildup of friction induced electrostatic charges as the belt moves across the platen, and the resistivity upper limit is high enough to enable electrostatic tacking of the media substrate to the belt.

* * * * *